US007431296B2

(12) United States Patent
Walsh et al.

(10) Patent No.: US 7,431,296 B2
(45) Date of Patent: Oct. 7, 2008

(54) GAMING APPARATUS AND METHOD

(75) Inventors: Jason Walsh, Escondido, CA (US); Kenneth J. Stetter, Jr., Lake Forrest, CA (US)

(73) Assignee: By George, Inc., Lake Forest, CA (US)

( * ) Notice: Subject to any disclaimer, the term of this patent is extended or adjusted under 35 U.S.C. 154(b) by 0 days.

(21) Appl. No.: 11/163,428

(22) Filed: Oct. 18, 2005

(65) Prior Publication Data

US 2007/0085267 A1 Apr. 19, 2007

(51) Int. Cl.
*A63F 9/04* (2006.01)

(52) U.S. Cl. ..... 273/146

(58) Field of Classification Search ..... 273/146
See application file for complete search history.

(56) References Cited

U.S. PATENT DOCUMENTS 3,899,838 A * 8/1975 Lalley et al. ..... 434/189
3,924,376 A * 12/1975 Tsurumi ..... 52/591.1
4,335,879 A * 6/1982 Wiskur ..... 273/260
4,899,946 A * 2/1990 Espin et al. ..... 242/546.1
5,261,666 A * 11/1993 Chen et al. ..... 273/146
5,385,473 A * 1/1995 Veltman ..... 434/205
5,415,413 A * 5/1995 Morinich ..... 273/271
5,427,375 A * 6/1995 Breckwoldt ..... 273/153 S
5,558,328 A * 9/1996 Krantz ..... 273/146
5,607,159 A * 3/1997 Bryson ..... 273/243
5,746,428 A * 5/1998 Fredenburg ..... 273/146
5,918,881 A * 7/1999 Kirby ..... 273/146

* cited by examiner

*Primary Examiner*—Gene Kim
*Assistant Examiner*—Dolores Collins
(74) *Attorney, Agent, or Firm*—Pattric J. Rawlins; Procopio Cory Hargreaves & Savitch LLP

(57) ABSTRACT

A multi-panel gaming apparatus is provided that uses interchangeable panels to create a structure that is used in playing a game. The panels interlock together to form the gaming apparatus and each panel has an active side and an inactive side. The active side is initially placed on the exterior surface of the structure and includes information relevant to the playing of the game. When a panel is eliminated from the game, the panel can be disconnected from the structure and turned over and then reconnected to the structure with the inactive side placed on the exterior surface. The gaming apparatus can have four sides, six sides, eight sides, twelve sides, or any other number of sides that allows for the interlocking panels to define a multi-panel structure.

1 Claim, 9 Drawing Sheets

GAMING APPARATUS AND METHOD

BACKGROUND

1. Field of the Invention

The present invention generally relates to gaming and more particularly relates to multi-panel dice and methods of using the dice to play a game.

2. Related Art

Conventional dice games are commonplace and typically use standard numbered dice that are rolled as part of playing the game. Conventional dice are typically plastic cubes that have fixed values/content on each panel when manufactured. Furthermore, conventional dice are merely a means for pseudo random input to the game being played and are not actually part of the game.

Therefore, what is needed is a gaming apparatus and method that overcomes these significant problems found in the conventional systems as described above.

SUMMARY

Accordingly, a multi-panel gaming apparatus is provided that uses interchangeable panels to create a structure that is used in playing a game. The panels interlock together to form the gaming apparatus and each panel has an active side and an inactive side. The active side is initially placed on the exterior surface of the die and includes information relevant to the playing of the game. When a panel is eliminated from the structure through the normal course of game play, the panel can be disconnected from the structure and turned over and then reconnected to the structure with the inactive side placed on the exterior surface of the structure. The multi-panel structure can have four sides, six sides, eight sides, twelve sides, or any other number of sides that allows for the interlocking panels to define a multi-panel structure.

The panels may also be interlocked in a planar structure or other three dimensional structure. These structures may combine image components from the active sides, inactive sides, or some combination of both to make a contiguous image when interlocked together. Other aspects of the invention will also be apparent upon a review of the detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a gaming apparatus that uses interchangeable interlocking panels to construct a multi-panel die for playing a game. Each panel used in the die has an active side and an inactive side. The active side is initially placed on the exterior surface of the die and includes information relevant to the playing of the game. When a panel is eliminated from the game, the panel can be removed from the die and flipped over and then reconnected to the die with the inactive side placed on the exterior surface of the die. The multi-panel die can be in the shape of a pyramid, cube, pentagon, hexagon, octagon, or any other shape that lends itself to the creation of a multi-panel die.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1A:
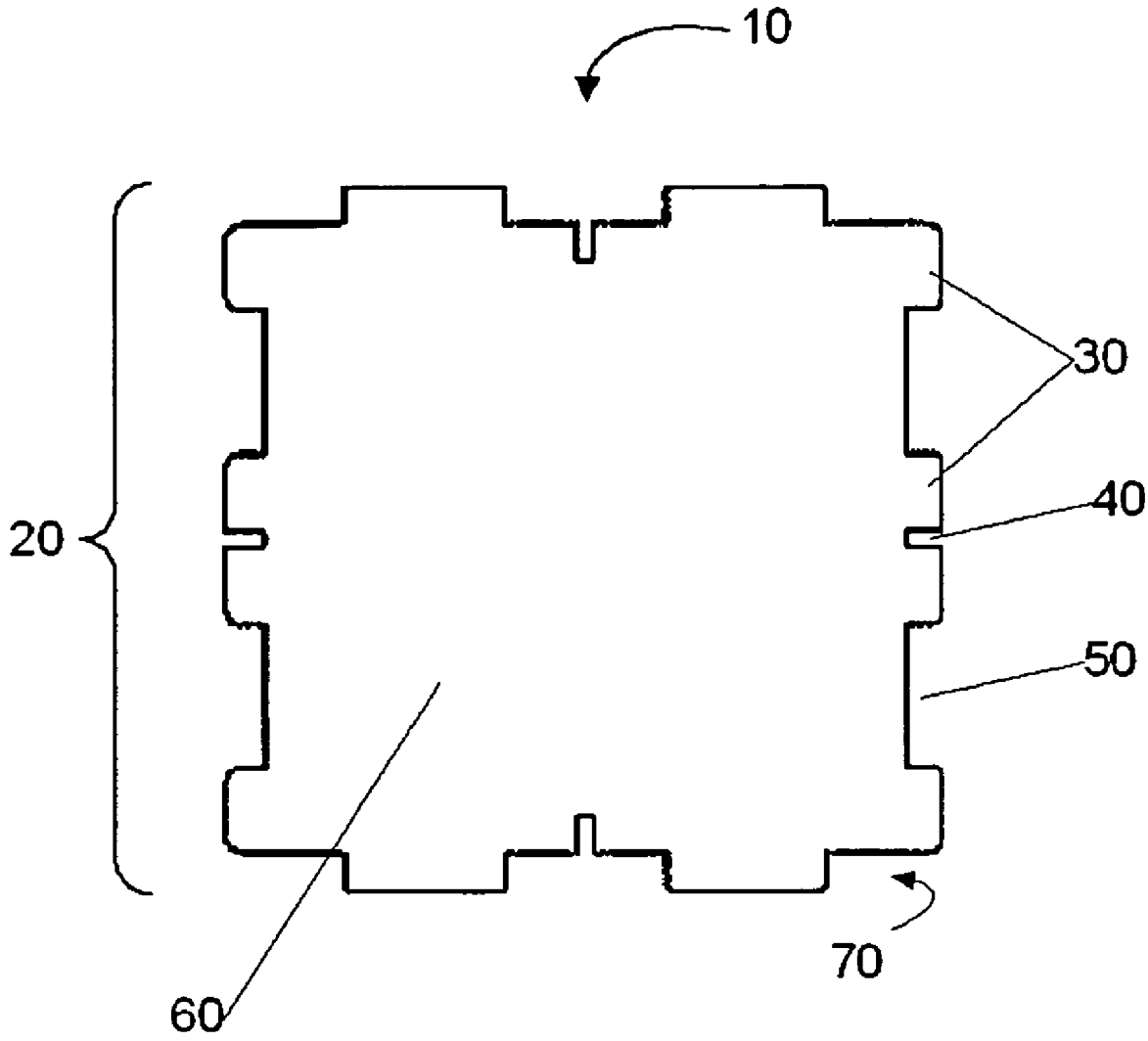
FIG. 1A is a block diagram illustrating an example panel of a gaming apparatus according to an embodiment of the present invention.

FIG. 1A is a block diagram illustrating an example panel 10 of a gaming apparatus according to an embodiment of the present invention. In the illustrated embodiment, the panel 10 has four edges such as edge 20.

Each edge has a series of connector tabs 30, connector notches 40, and connector recesses 50. The disposition of the various connectors 30, 40, and 50 can vary according to implementation but serve the function of allowing the panel 10 to interlock with other panels (not shown). The panel 10 also has a front side 60 and a back side 70.

Figure 1B:
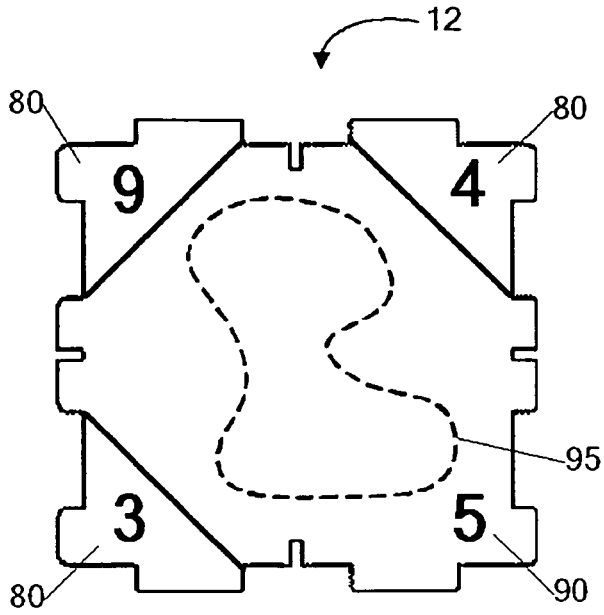
FIG. 1B is a block diagram illustrating an example panel of a gaming apparatus according to an embodiment of the present invention.

FIG. 1B is a block diagram illustrating an example panel 12 of a gaming apparatus according to an embodiment of the present invention. In the illustrated embodiment, the panel 12 has game related information provided on its front side. For example, the gaem related information may include various categories 80 that may, as shown in the illustrated embodiment, have numerical values associated with them. In one embodiment, the front side of the panel 12 may have a primary category 90, which may also have a numerical value. The front side of the panel 12 may also include other information such as a character 95. In an alternative embodiment, the back side of the panel 12 (not shown) may include non-game related information to indicate that it is inactive during game play. Additionally, alternative panels may be wildcards or special panels that are used for various purposes during game play and may therefore not have any categories, numerical values, characters or other standard types of game information.

Figure 2:
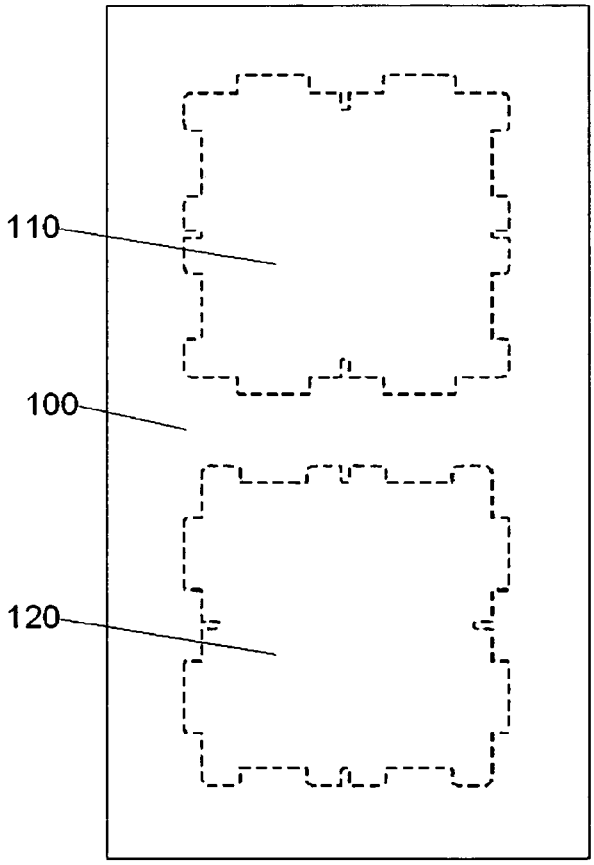
FIG. 2 is a block diagram illustrating an example sheet of panels for a gaming apparatus according to an embodiment of the present invention.

FIG. 2 is a block diagram illustrating an example sheet 100 of panels 110 and 120 for a gaming apparatus according to an embodiment of the present invention. In the illustrated embodiment, the sheet 100 comprises two panels 110 and 120 that may be perforated for easy removal from the sheet 100. In alternative embodiments, there may be more than two panels on a sheet. Advantageously, providing two panels 110 and 120 on a single sheet may allow for more economical and ergonomic packaging for distribution of the panels 110 and 120 to players.

Figure 3:
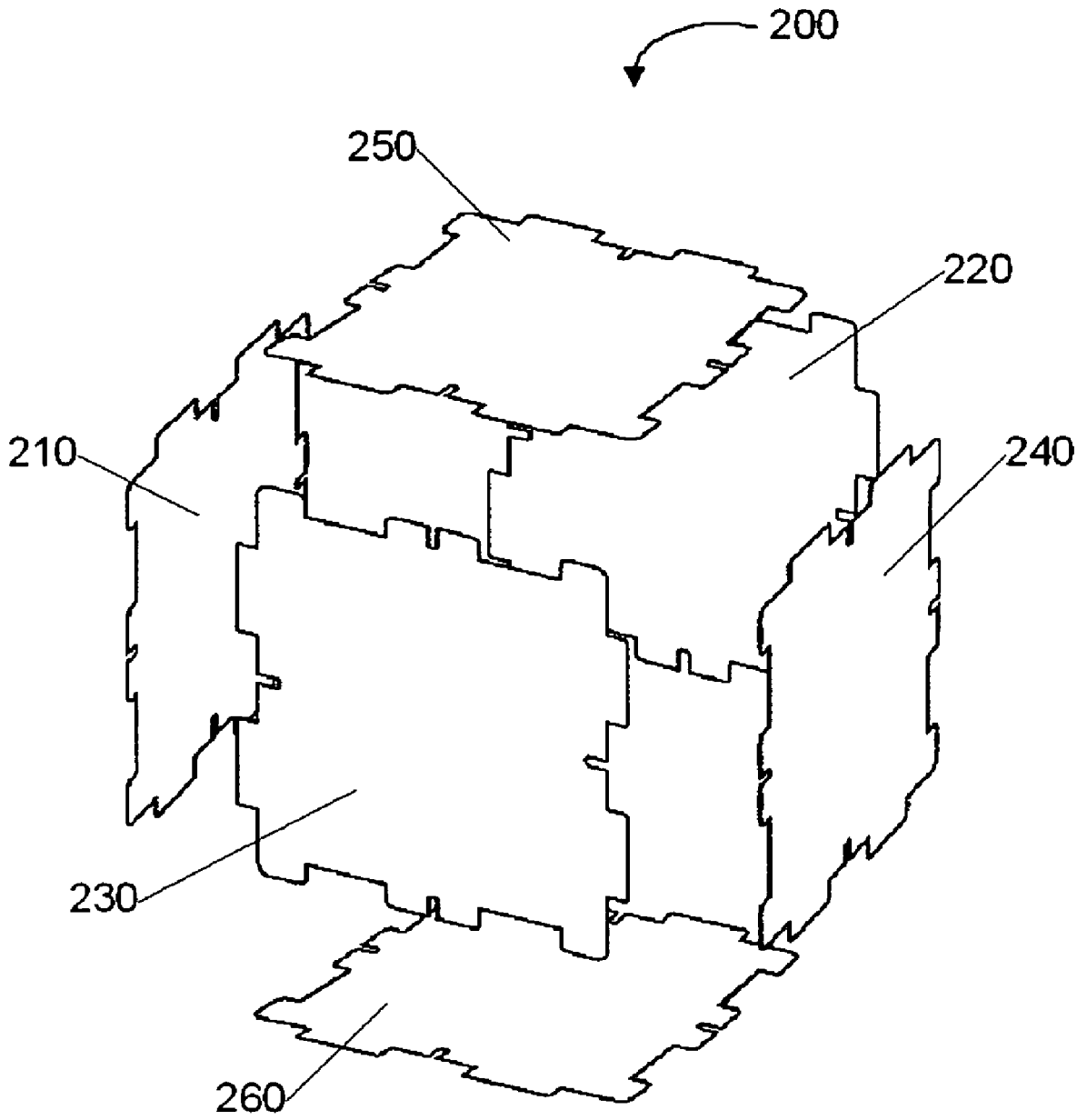
FIG. 3 is a block diagram illustrating an example an exploded view of a cube shaped gaming apparatus made from a plurality of panels according to an embodiment of the present invention.

FIG. 3 is a block diagram illustrating an example an exploded view of a cube shaped gaming apparatus 200 made from a plurality of panels according to an embodiment of the present invention. In the illustrated embodiment, the cube is made up of a first panel 210, a second panel 220, a second opposing panel 230, a first opposing panel 240, a top panel 250 and a bottom panel 260.

When constructing the gaming apparatus 200 from the plurality of panels, first the connector tabs of the left edge of the first panel 210 are interlocked with the connector tabs of the right edge of the second panel 220. Next, the connector tabs of the right edge of the first panel 210 are interlocked with the connector tabs of the left edge of the second opposing panel 230. Then the connector tabs of the left edge of the second panel 220 are interlocked with the connector tabs of the right edge of the first opposing panel 240, and the connector tabs of the left edge of the first opposing panel 240 are interlocked with the connector tabs of the right edge of the second opposing panel 230. Finally, the connector tabs of the top panel 250 are interlocked with the connector tabs of the top edge of each of the first panel 210, second panel 220, first opposing panel 240, and second opposing panel 230 and then the connector tabs of the bottom panel 260 are interlocked with the connector tabs of the bottom edge of each of the first panel 210, second panel 220, first opposing panel 240, and second opposing panel 230, and second opposing panel to form the gaming apparatus 200.

Figure 4:
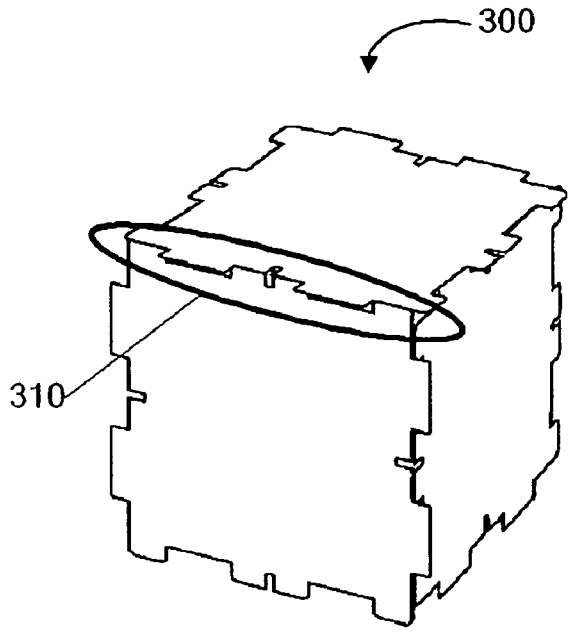
FIG. 4 is a block diagram illustrating an example six (6) sided gaming apparatus made from a plurality of panels according to an embodiment of the present invention.

FIG. 4 is a block diagram illustrating an example six (6) sided gaming apparatus 300 made from a plurality of panels according to an embodiment of the present invention. As shown in the illustrated embodiment, the gaming apparatus 300 has a plurality of interlocking panels. Area 310 shows two interlocking panels of the gaming apparatus 300. Alternative configurations of connector tabs, connector recesses, and connector notches can be employed. One particularly advantageous function of the illustrated configuration is that each panel is interchangeable with other panels and also reversible so that either the front side or the back side of the panel may be part of the exterior surface of the gaming apparatus 300.

Figure 5:
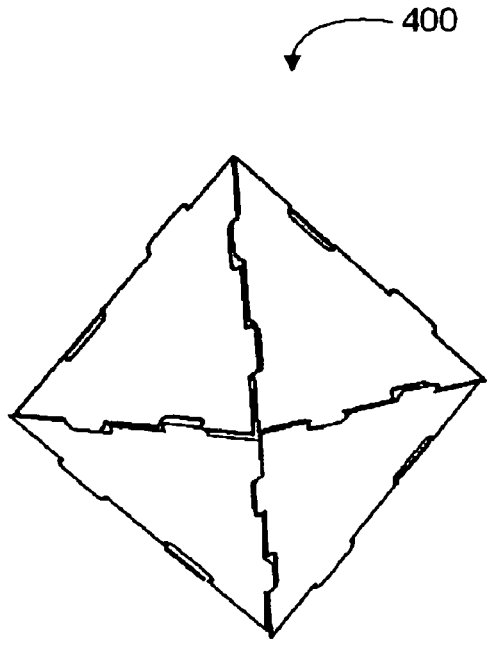
FIG. 5 is a block diagram illustrating an example eight (8) sided gaming apparatus according to an embodiment of the present invention.
Figure 6:
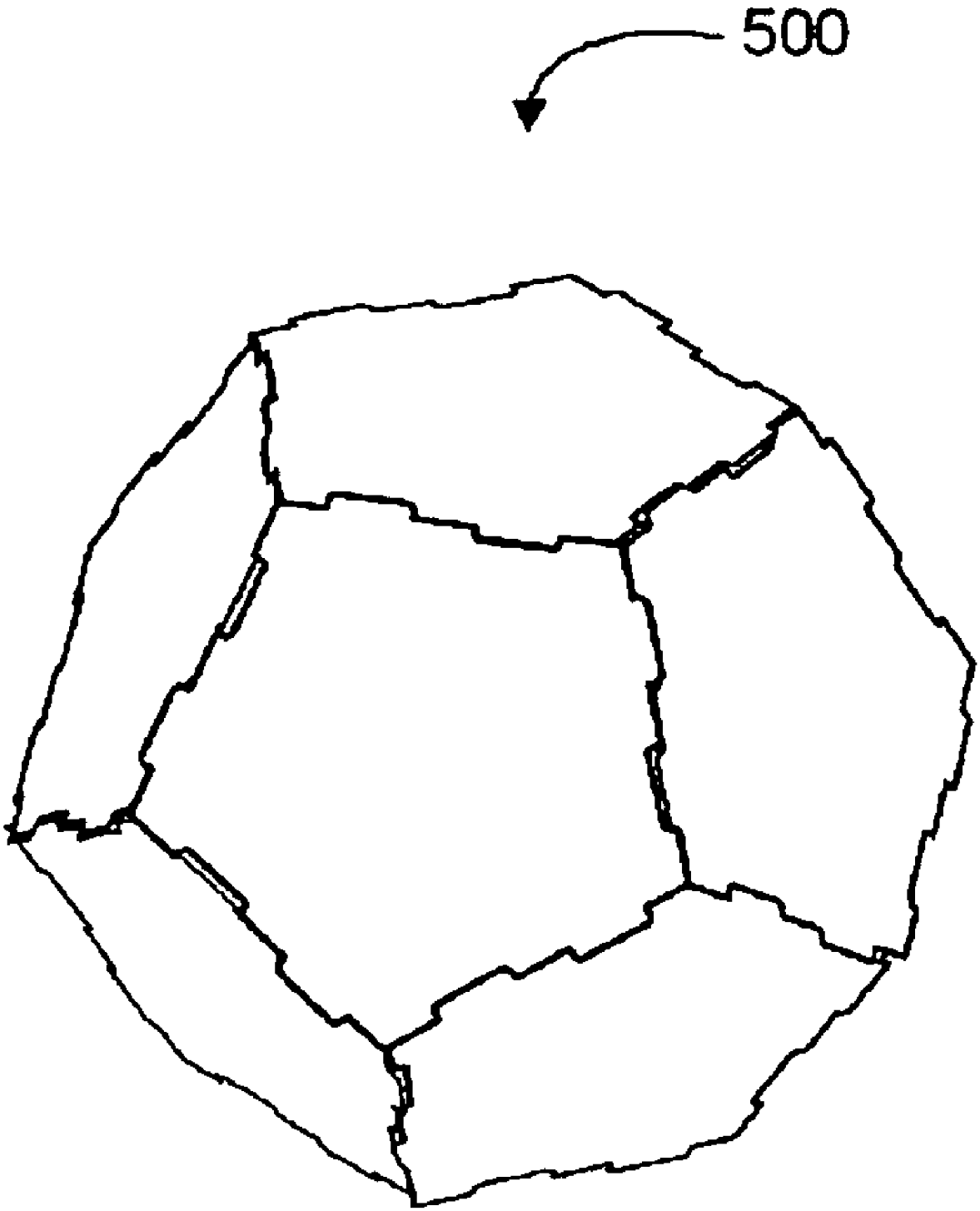
FIG. 6 is a block diagram illustrating an example twelve (12) sided gaming apparatus according to an embodiment of the present invention.

Notably, the gaming apparatus can have many different shapes. In FIG. 4 the gaming apparatus 300 is shown as a cube having six (6) sides. In FIG. 5, the gaming apparatus 400 is shown as an eight (8) sided structure. In FIG. 6, the gaming apparatus 500 is shown as a twelve (12) sided structure. Other embodiments may employ even further different shapes for the gaming apparatus. In one embodiment, multiple cubes having different shapes may be used.

Figure 7:
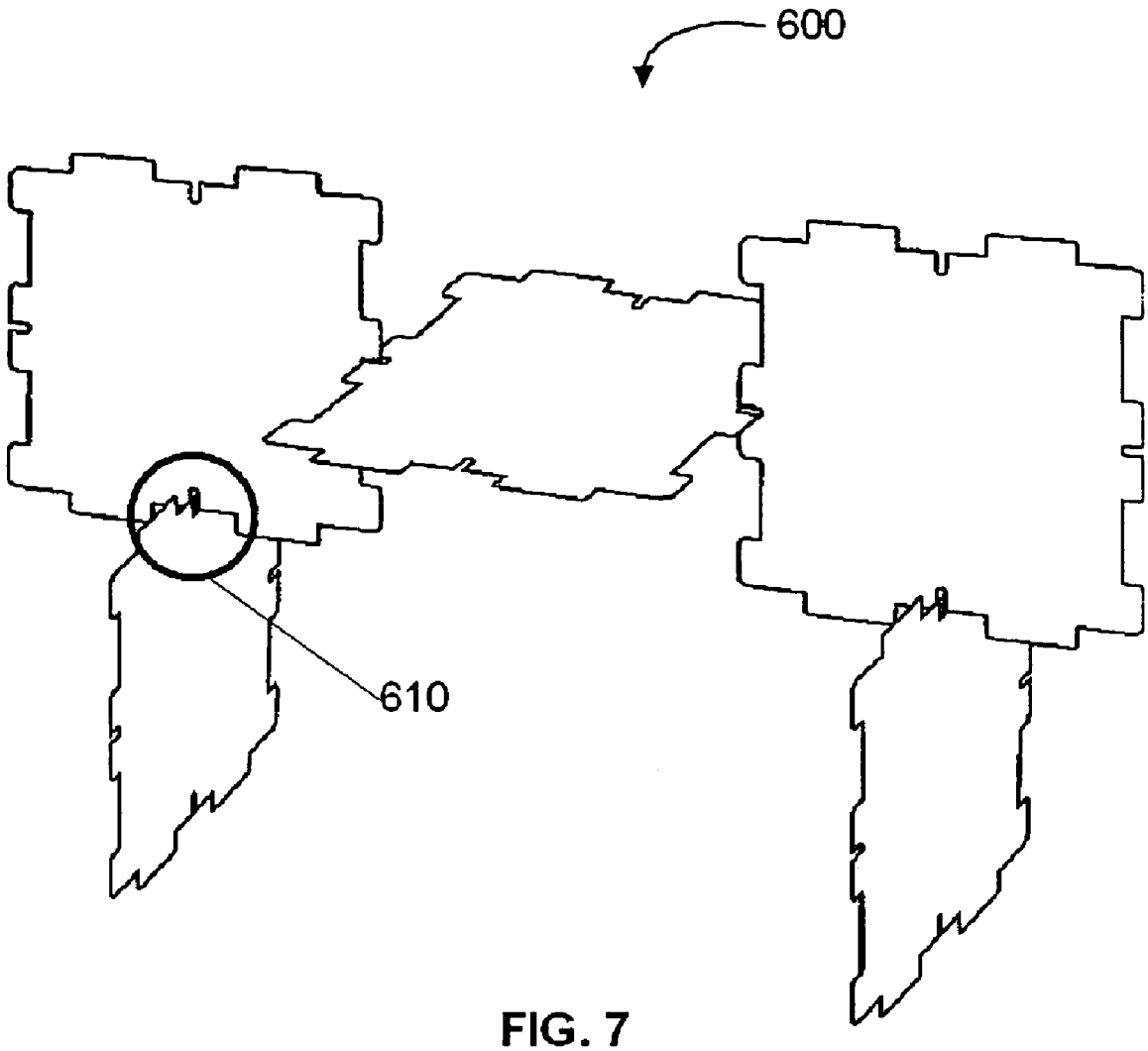
FIG. 7 is a block diagram illustrating an example three dimensional structure made from a plurality of panels according to an embodiment of the present invention.

FIG. 7 is a block diagram illustrating an example three dimensional structure 600 made from a plurality of panels according to an embodiment of the present invention. In the illustrated embodiment, the structure 600 is made by interlocking a plurality of panels using the connection notches of each panel, such as the interlocking shown in connection 610. Advantageously, using the connection notches to interlock panels places the connected edges of the interlocked panels orthogonal to each other. This is in contrast to connecting the panels using the connector tabs and connector recesses that place the connected edges of two interlocked panels adjacent to each other along the subject edges. In one embodiment, a structure can be built from a plurality of panels using a combination of connection notch and connection tab/recess interlockings. For example, a simple bridge or house structure can be built so that when the structure is complete, the separate images on the panels (e.g., the back side) provide a contiguous image of the structure being built. In one embodiment, the structure itself may be a three dimensional replication of a certain character (in the game or otherwise) using various different shaped panel pieces, for example from a six (6) sided structure, an eight (8) sided structure, and a twelve (12) sided structure.

Figure 8:
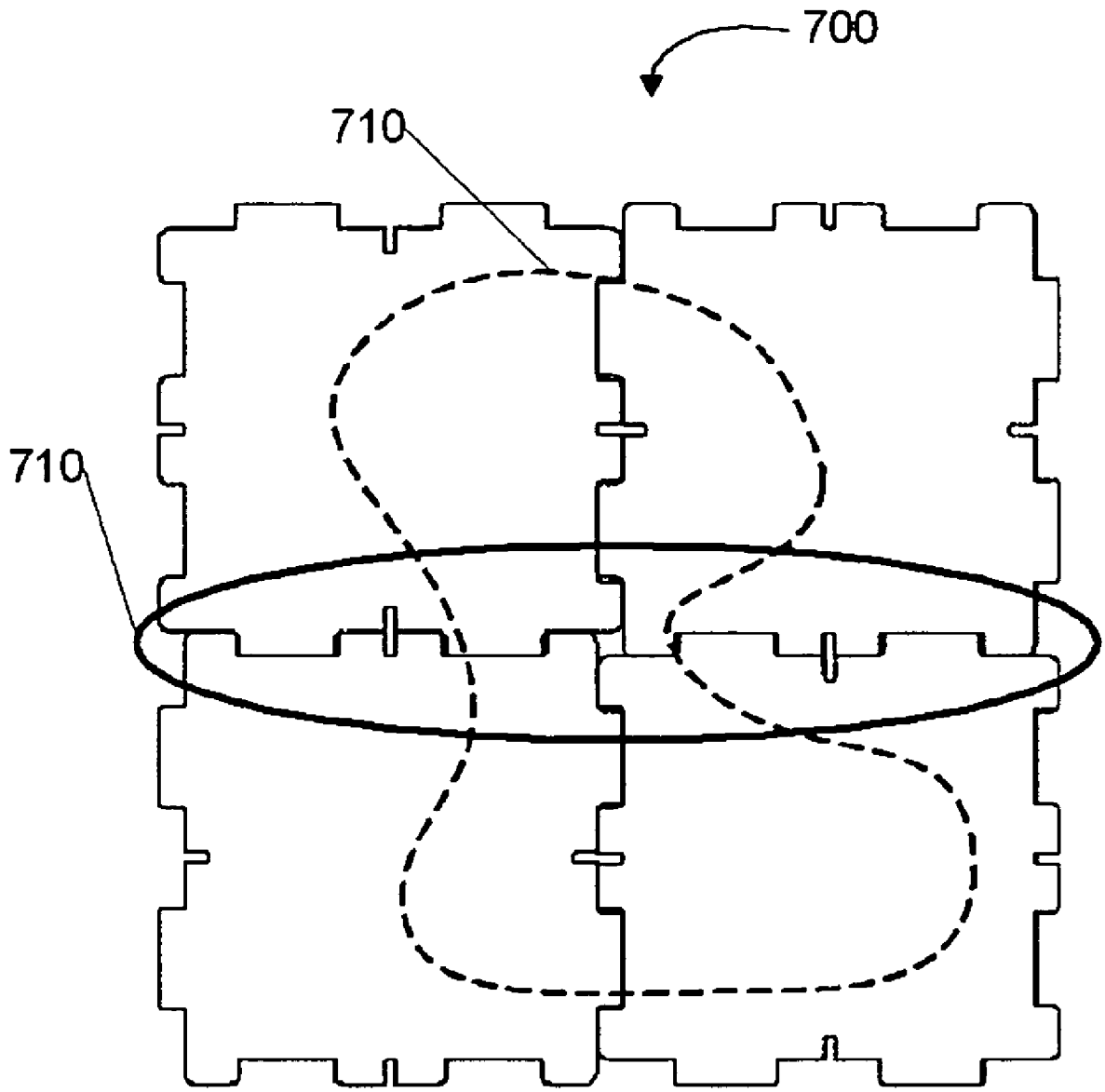
FIG. 8 is a block diagram illustrating an example planar surface structure made from a plurality of panels according to an embodiment of the present invention.

FIG. 8 is a block diagram illustrating an example planar surface structure 700 made from a plurality of panels according to an embodiment of the present invention. In the illustrated embodiment, the structure 700 is substantially flat and the various panels are interlocked using the connector tabs and recesses. Some of these interlockings are shown along the connection 710. In one embodiment, the separate images on each panel (e.g., the back side of the panel) may collectively provide a contiguous image 720 when the panels are joined into the structure 700.

Figure 9:
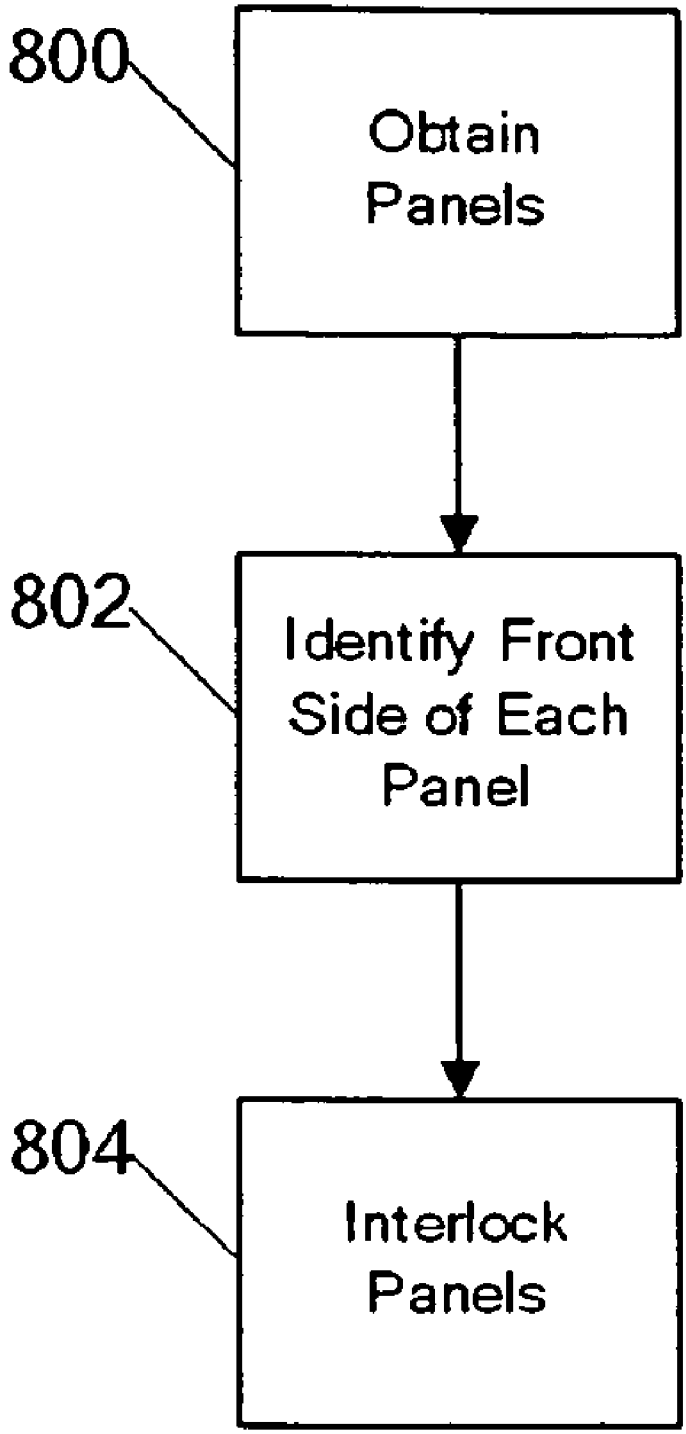
FIG. 9 is a flow diagram illustrating an example process for making a gaming apparatus according to an embodiment of the present invention.

FIG. 9 is a flow diagram illustrating an example process for making a gaming apparatus according to an embodiment of the present invention. Initially, in step 800, the various panels that make up the gaming apparatus are obtained. When interlocked, the panels may make a cube shaped gaming apparatus or a gaming apparatus of another shape that has a different number of sides, for example, eight (8) sides or twelve (12) sides. Next, in step 802, the front side of each panel is identified. In one embodiment, the front side of each panel is the "active" side for the game while the back side of each panel is the "inactive" side. This allows the gaming apparatus to initially be at full power and then through the course of the game to lose power as the sides are flipped from active to inactive during the normal course of play. Finally, in step 804 the various panels are interlocked to form the gaming apparatus. Preferably, the interlocked panels define a substantially completely closed off interior surface such that the gaming apparatus can be rolled as a die.

Figure 10:
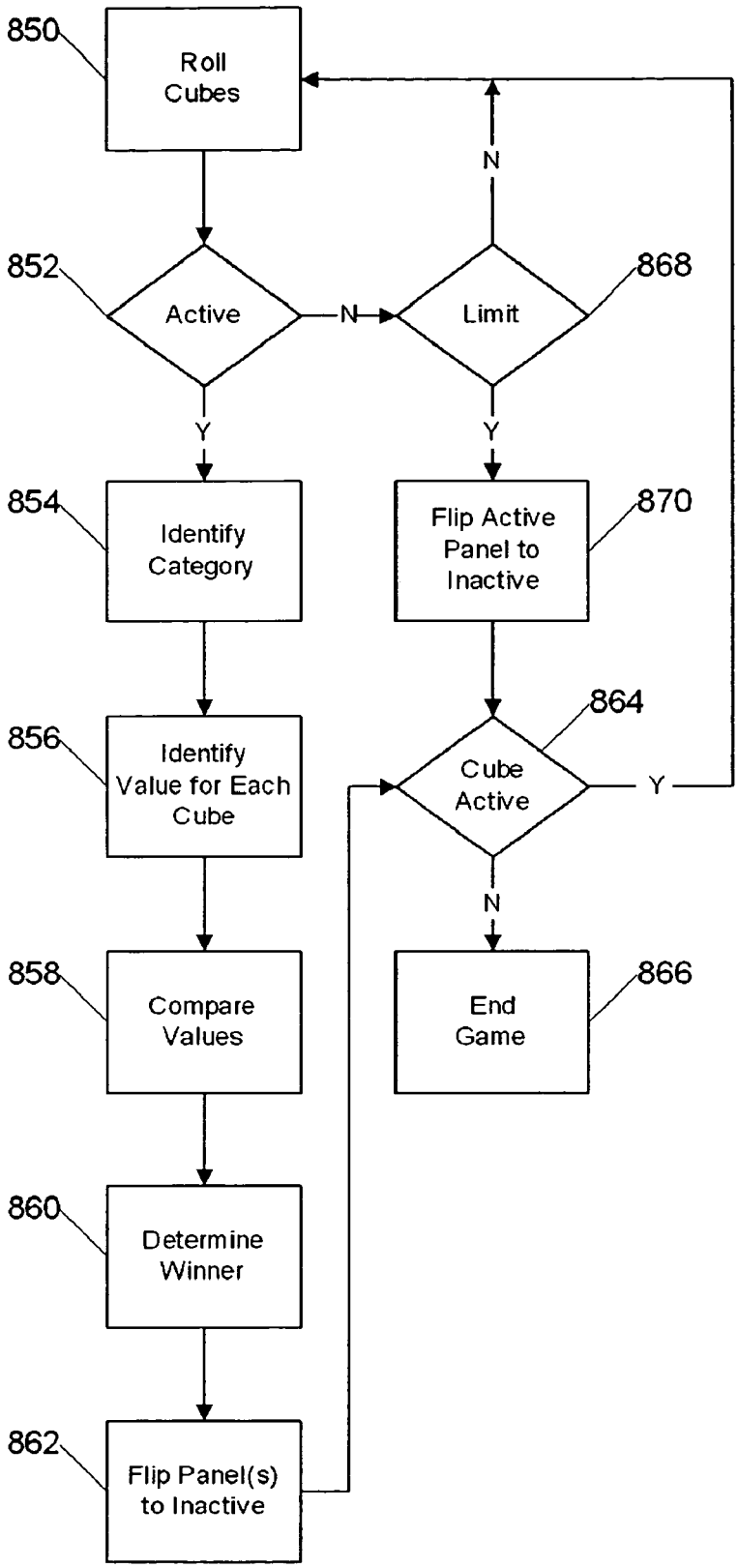
FIG. 10 is a flow diagram illustrating an example process for playing a game with a gaming apparatus according to an embodiment of the present invention.

FIG. 10 is a flow diagram illustrating an example process for playing a game with a gaming apparatus according to an embodiment of the present invention. Initially, in step 850 a player rolls the gaming apparatus (which will be described as a cube for the purposes of this example). One or more cubes may be rolled by one or more players either simultaneously or serially. In this embodiment, each player rolls the same number of cubes, for example each player rolls one cube.

Once the cubes have been rolled, the panel of the cube that is facing up is examined to see whether the panel is currently active, as determined in step 852. If the panels are both active, then a category for the contest is determined in step 854. For example, a category may be predetermined such that the primary category for a particular player's rolled cube becomes the category for the contest. Alternatively, a category may be dynamically determined such that the rolled cube with the highest primary category defines the category for the contest. Alternatively, the categories may rotate through a predetermined pattern. Other methods for selecting a category may also be employed.

Upon identifying a category for the contest, the value of the panel that is facing up for each rolled cube is determined in step 856 and then those values are compared in step 858. The comparison of values is the contest. In one embodiment where multiple cubes are rolled by each player, then the aggregate value of the rolled cubes can be used. A winner is determined in step 860 as the player with the highest value. When a player loses a contest, that player must turn over those panels rolled during the current round of the game (or a subset of the rolled panels) so that the inactive side of the panel is thereafter part of the exterior surface of the cube, as shown in step 862.

After a panel is flipped, the current round is completed. Next, in step 864 it is determined if the player's cube or cubes are still active. An active cube has at least one active panel. If all panels are inactive for the player's cube or cubes, then the cube is inactive and the player loses and the game ends, as illustrated in step 866. Alternatively, if the cube is still active as determined in step 864, then the game returns to step 850 where the cubes are rolled again for another round.

In a round when a player rolls an inactive panel, the player may re-roll the cube as many times as necessary until an active panel is rolled. In one embodiment, a limit to the number of times a player may freely re-roll the cube for an active panel can be imposed. Thus, if an inactive panel is rolled, as determined in step 852 and the number of consecutive inactive panel rolls exceeds the limit, as determined in step 868, then the player must turn over an active panel as a penalty, as shown in step 870. Alternative ways for penalizing inactive panel rolls may also be employed.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A method for creating a gaming apparatus, comprising:

providing a plurality of panels, each panel comprising a top edge, bottom edge, left edge and right edge, wherein each edge has one or more connector tabs, the first panel also having a front side and a back side wherein the front side represents an active game piece and the back side represents an inactive game piece;

interlocking the connector tabs of the left edge of a first panel to the connector tabs of the right edge of a second panel;

interlocking the connector tabs of the right edge of the first panel to the connector tabs of the left edge of a second opposing panel;

interlocking the connector tabs of the left edge of the second panel to the connector tabs of the right edge of a first opposing panel;

interlocking the connector tabs of the left edge of the first opposing panel to the connector tabs of the right edge of the second opposing panel;

interlocking the connector tabs of a top panel to the connector tabs of the top edge of each of the first panel, second panel, first opposing panel, and second opposing panel; and interlocking the connector tabs of a bottom panel to the connector tabs of the top edge of each of the first panel, second panel, first opposing panel, and second opposing panel to form a cube;

each panel of the cube initially being oriented with the front side facing outwards whereby the exterior surface of the cube comprises all active game pieces; and subsequently removing at least one panel from the cube and replacing the panel in the cube with the back side facing outwards, whereby the exterior surface of the cube comprises both inactive and active game pieces.

* * * * *